United States Patent [19]

Aichinger et al.

[11] 4,016,996

[45] Apr. 12, 1977

[54] CONTAINER WITH SCREW CAP AND SEAL

[75] Inventors: Dietmar Aichinger, Arlesheim; Albert Obrist, Reinach, both of Switzerland

[73] Assignee: Albert Obrist AG, Reinach, Switzerland

[22] Filed: June 22, 1976

[21] Appl. No.: 698,597

[30] Foreign Application Priority Data

July 1, 1975 Germany ..... 2529340

[52] U.S. Cl. ..... 215/344; 215/DIG. 1

[51] Int. Cl.[2] ..... B65D 53/00

[58] Field of Search ..... 215/320, 343, 344, DIG. 1

[56] References Cited

UNITED STATES PATENTS

| | | | |
|---|---|---|---|
| 3,038,624 | 6/1962 | Wieckmann | 215/DIG. 1 |
| 3,200,981 | 8/1965 | Harding | 215/344 X |

*Primary Examiner*—George T. Hall

*Attorney, Agent, or Firm*—Larson, Taylor & Hinds

[57] ABSTRACT

A container having an external screw thread is closed by a synthetic plastics stopper comprising an internally threaded cap with a seal part protruding from the cap top, this seal part having an outwardly protruding seal section which in use is bent back outwardly by the inner wall of the container neck. The screw thread on the container neck, the screw thread on the cap and the seal section are such in relation to one another that in applying the stopper the seal section contacts the container neck and is bent back thereby before the external screw thread on the container and the internal thread on the cap come into engagement with one another. The seal section preferably consists of permanently deformable material so that on unscrewing the stopper, the seal between the stopper and the container opening is broken before the threads come out of engagement.

4 Claims, 8 Drawing Figures

CONTAINER WITH SCREW CAP AND SEAL

FIELD OF THE INVENTION

This invention is concerned with a container having external screw threading and a synthetic plastics screw stopper comprising an internally threaded screw cap from the top of which an approximately cylindrical seal part protrudes centrally, an outwardly projecting seal section, of this seal part, on introduction into the container neck, being bent back outwards and abutting in sealing manner with its outer edge on the cylindrical inner wall of the container neck. The invention is also concerned with a method for fitting such a screw cap upon a container.

BACKGROUND OF THE INVENTION

Containers and screw caps of this kind are already known and described for example in published German Patent Application No. 1,043,847 dated Sept. 22, 1955. The advantage of this arrangement of the seal as an approximately circular seal section or as a seal fin which comes into engagement with the inner wall of the container, is primarily in that tolerances of the container neck can be compensated especially well by the deformable seal section.

However in practice these screw stoppers have not become established because of various drawbacks in design. One great disadvantage of these known screw stoppers is that the seal section comes into engagement with the container neck only after the screwing operation has commenced. This often leads to the seal section tilting slightly under the rotatory movement whilst being screwed into position, when it is pressed slowly into the container neck. The seal section is then irregularly bent back or even, in the case of major tilting, is so damaged that a satisfactory seal can no longer be achieved.

Especially in the bottling of liquids under pressure, such for example as beverages containing carbon dioxide, a further serious disadvantage of the known containers and screw stoppers is that frequently the seal sections are still in engagement with the container neck when the screw threads are already almost completely disengaged. This leads to the possibility of the screw stopper bursting explosively away from the container, whereby there is considerable danger of injury.

SUMMARY OF THE INVENTION

The present invention has for an object to solve the problem of avoiding the disadvantages of the prior art, that is to say to produce a container having a synthetic plastics screw stopper, and a method for the fitting of the screw cap, which ensures reliable sealing, a simple construction of the screw cap and a safe opening of the screw stopper.

According to the invention, the external screw threading of the container neck, the internal threading of the screw cap and the seal section are arranged in relation to one another in such a way that, when the screw stopper is first fitted, the seal section comes into engagement with the upper edge of the container neck and is at least partially bent back by the latter, before the external screw thread and the internal thread engage with one another. Thus, in the simplest way, it is ensured that before the commencement of the turning operation the seal section is already bent over and has already penetrated so far into the container neck that there is no fear of damage of the seal section by the edge of the container during the subsequent turning. Preferably the seal section is formed of a permanently deformable material. A number of such materials are already known for bottle stoppers and are available to the person acquainted with the art.

In an optimally simple manner, springing away of the screw cap during the opening of a pressurized container can be avoided if the seal section of the seal part, after the complete screwing on of the screw cap, is so bent back that during unscrewing, the deformed seal section comes out of engagement with the upper edge of the container opening before the screw threading is in engagement with the internal threading by less than one half turn. Thus, without additional measures, it is ensured that the screw cap is still seated sufficiently firmly on the external screw threading of the container neck when there is already sufficient clearance between the seal section and the upper edge of the container opening to achieve a relaxation of pressure. This is especially advantageous in the case of bottles for beverages containing carbon dioxide, where extraordinarily high pressures can build up under high temperatures.

BRIEF DESCRIPTION OF THE DRAWINGS

As shown in FIG. 1, a container 1 has a neck 2 which is provided with an external screw thread 3. The container neck 2 is closable by a synthetic plastics screw stopper 4 which consists of a screw cap 5 with an internal thread 6. From the centre of the cap top 7, a cylindrical seal part 8 protrudes and has a radially outwardly protruding seal section 9.

Figure 1:
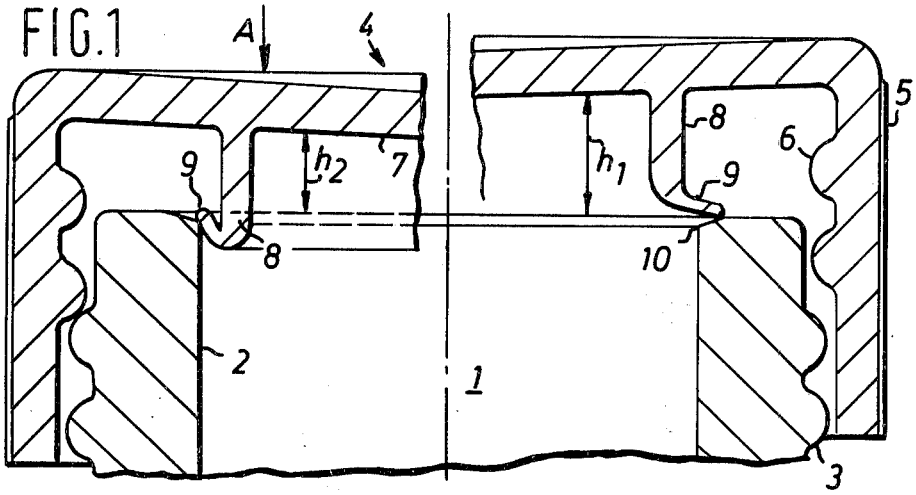
FIG. 1 is a cross-section through a screw cap and a container neck in accordance with the invention.

In the right hand half of FIG. 1 it is shown diagrammatically how the lower lip of the seal section 9 first comes into contact with the inner edge 10 of the neck 2 before the screw stopper 4 is screwed on to the neck 2.

Figure 1A:
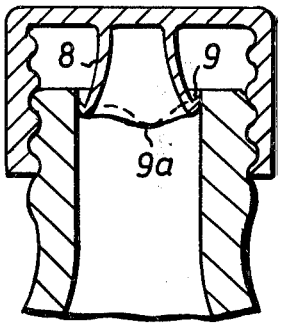
FIG. 1*a* is a section through a conventional screw stopper.

If turning movement of the screw stopper 4 for screwing on to the neck 2 were already to commence at this stage, obviously there would be a danger that the seal section 9 would not be bent over upwards in U-form throughout, but that the lower edge of the seal section 9 would be partly tilted downwards into the neck 2. FIG. 1*a* shows in cross-section a conventional screw stopper tilted in this way and the seal section 9 deformed in screwing on, so that at 9*a* obviously its sealing action is no longer ensured. As illustrated in the left hand half of FIG. 1, in the case of the present invention, before commencement of screwing of the cap on to the container a force acting in the direction indicated by the arrow is first exerted upon the screw stopper 4. Thus, as illustrated, the seal section 9 is so far bent back that during the subsequent screwing on tilting of the seal section 9 cannot take place. Rather, the neck 2 is pushed slowly into the interspace between the internal threading 6 and the seal part 8, further deforming the seal section 9, so that satisfactory bending back of the seal section 9 and thus reliable sealing effect are ensured.

Figure 2:
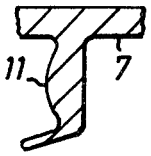
FIG. 2 shows a modified form of the seal section.

The seal section 9 of the seal part 8 can of course be modified according to the particular shape of the bottle neck 2 and according to requirements in individual cases, without thereby departing from the scope of the invention. It is for example conceivable to form the seal section 9 as a fin protruding radially outwards in circular form from the seal part 8, or to provide the seal part 8 with a reinforcement or thickening 11, as illustrated in FIG. 2.

Figure 3:
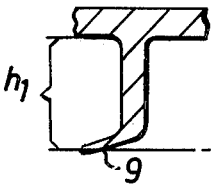
FIGS. 3 to 5 show diagrammatically the operation of the seal section.
Figure 4:
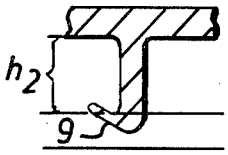
Figure 5:
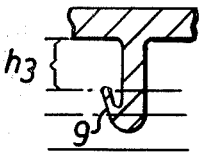

FIGS. 3 to 5 show diagrammatically stages in the deformation of the seal section 9 during pressing into the neck 2. FIG. 3 shows the seal section 9 in the original form. The seal section 9 lies at a level $h_1$ upon the inner edge of the neck 2, $h_1$ determining the distance from the top 7 of the cap. FIG. 4 shows the deformation of the seal section 9 after the screw stopper 4 has been pressed on to the neck 2, but before the screwing on operation has commenced. As may be seen, the seal section 9 is already bent back in U-form in such a way that no tilting of any kind can take place when the turning operation is commenced. Moreover, the distance $h_2$ of the sealing point from the cap top 7 has been reduced. FIG. 5 shows the screw stopper 4 in the completely screwed-on condition. Here the seal section 9 has been bent back completely in U-form, so that the distance $h_3$ of the sealing radius from the top 7 of the cap has been further reduced. When ordinary commercial synthetic plastics materials, as for example polypropylene or polyethylene mixtures such as are entirely familiar in the art, are used, the deformation illustrated in FIGS. 3 to 5 is permanent. This means that on applying the stopper for the first time to a container 1 the seal section 9 has been bent out of the position according to FIG. 3 into the position according to FIG. 5, and remains in this position on re-opening of the container 1.

Figure 6:
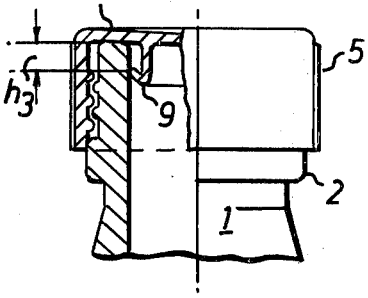
FIG. 6 is a partial section through a closed bottle.
Figure 7:
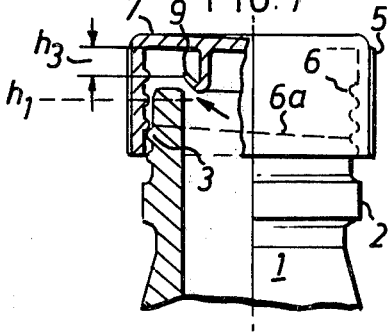
FIG. 7 is a partial section through a half-opened bottle according to the invention.

The final deformation of the seal section 9 may again be seen in the partially sectional representations according to FIGS. 6 and 7. It will be seen that the above-described deformation operation achieves the object that after the screw cap 5 has first been placed upon the container neck 2 the distance $h_3$ of the sealing radius from the cap top 7 has been reduced, in relation to the distance $h_1$ before deformation, in such a way that on re-opening of the container 1, possible excess pressure in the container 1 can be diminished in complete safety, since the screw cap 5 is still seated with a half thread turn 6*a* on the neck 2. It is thus ensured that the screw cap 5 cannot be propelled away by the internal pressure, as would be the case if the seal section 9 were to return into its position according to FIG. 3.

As may be seen, the described formation of the screw cap 5 and the selection of the method steps ensure that on the one hand before the application and turning of the screw cap 5 the seal section 9 can be bent at least partially into its sealing position without damage and on the other hand the final deformation ensures danger-free opening of the container 1. It is possible in the individual case and in the case of special formation of the internal threading 6, the screw threading 3 or the seal part 8, to modify in each case the remaining components responsible for the distance $h_1$ to $h_3$ in such a way that the function in the described manner is guaranteed. The essential point here is that the arrangement of the individual parts is so selected that the deformation of the seal part 8 commences before the actual turning of the screw cap 5 and that, especially in the case of pressurized containers 1, the deformation of the seal part 8 or of the seal section 9 reduces the distance of the sealing radius from the cap top 7 in such a way that the seal section 9 is separated from the inner edge of the neck 2 so far that pressure equalisation can take place before the screw cap 5 has slackened too far on the neck 2, or is seated on the screw threading 3 with less than one half thread turn. Here again the exact dimensioning is dependent upon the tolerances between the internal threading 6 and the screw threading 3 which should be taken into account by the designer in determining a particular form of embodiment. However, this represents no difficulty of any kind for a person acquainted with the art and can be practically realised and modified readily without thereby departing from the scope of the invention.

We claim:

1. In the combination of a pressurized container having an externally screw threaded neck and a synthetic plastics screw stopper comprising an internally threaded screw cap and a seal part protruding centrally from the cap top and having an outwardly protruding seal section which on introduction into the container neck is bent back outwards and abuts in sealing manner with its outer portion on the cylindrical inner wall of the container neck, the improvement that the external screw threading of the container neck, the internal threading of the screw cap, the seal part, and the seal section are so formed in relation to one another that at least in the first application of the screw stopper to the container the seal section engages with the container neck and is bent back at least partially by the latter before the external screw threading and the internal threading engage with one another.

2. The combination as defined in claim 1, wherein the seal section consists of substantially permanently deformable material.

3. In the combination of a pressurized container having an externally screw threaded neck and a synthetic plastics screw stopper comprising an internally threaded screw cap and a seal part protruding centrally from the cap top and having an outwardly protruding seal section which on introduction into the container neck is bent back outwards and abuts in sealing manner with its outer portion on the cylindrical inner wall of the container neck, the improvement that the external screw threading of the container neck, the internal threading of the screw cap, the seal part and the seal section are so formed in relation to one another that at least in the first application of the screw stopper to the container the seal section engages with the container neck and is bent back at least partially by the latter before the external screw threading and the internal threading engage with one another, and wherein the seal section of the seal part is bent back and deformed at least temporarily by the screwing on of the screw cap such that on unscrewing the cap the deformed seal section is at least partially disengaged from the neck so as to unseal the container before disengagement of the screw threads, whereby to avoid unintended blow-off of the cap.

4. The combination as defined in claim 1, wherein the seal part is thickened between the seal section and the cap top.

* * * * *